United States Patent [19]

Stoffers et al.

[11] 3,943,944

[45] Mar. 16, 1976

[54] APPARATUS FOR MAKING AND SEPARATING WRAPPED CIGAR BUNCHES

[75] Inventors: Helmut Stoffers, Geesthacht; Rudolf George; Helmut Niemann, both of Hamburg; Willy Rudszinat, Dassendorf, all of Germany

[73] Assignee: Hauni-Werke Korber & Co. KG, Hamburg, Germany

[22] Filed: Dec. 12, 1973

[21] Appl. No.: 426,627

[30] Foreign Application Priority Data

Dec. 19, 1972 Germany ..... 2262064

[52] U.S. Cl. ..... 131/59; 83/2; 83/660; 131/65

[51] Int. Cl.[2] ..... A24C 1/36

[58] Field of Search ..... 131/59, 34, 94, 63, 65, 131/117, 118, 83 R, 83 A; 83/2, 30, 660

[56] References Cited

UNITED STATES PATENTS

| | | | |
|---|---|---|---|
| 2,078,227 | 4/1937 | Blum | 131/4 R X |
| 3,238,951 | 3/1966 | Silberman | 131/59 UX |
| 3,483,873 | 12/1969 | Hinzmann | 131/94 X |
| 3,701,353 | 10/1972 | Pasquine et al. | 131/94 X |

FOREIGN PATENTS OR APPLICATIONS

| | | | |
|---|---|---|---|
| 1,929,446 | 12/1965 | Germany | 131/59 |
| 467,031 | 2/1969 | Switzerland | 131/10.7 |

*Primary Examiner*—Robert W. Michell
*Assistant Examiner*—John F. Pitrelli
*Attorney, Agent, or Firm*—Kane, Dalsimer, Kane, Sullivan and Kurucz

[57] ABSTRACT

Apparatus for wrapping cigar bunches has a first conveyor consisting of two endless belts having filler-engaging stretches which cross each other in space and move a single file of bunches lengthwise while simultaneously rotating the bunches about their axes. One of the stretches feeds an adhesive-coated web which is convoluted around successive bunches to form a tube consisting of partially overlapping helices. The tensile strength of the tube is reduced between successive wrapped bunches by a row of needles mounted on an endless toothed belt or drum which makes with the path of the tube a first angle equal to the angle between the plane of one belt of the first conveyor and the axis of the tube. The row of needles on the toothed belt or drum makes with the plane of the toothed belt or drum a second angle which equals 90° minus the first angle. This insures that the needles penetrate into the tube while moving with the tube at the speed of lengthwise movement of the bunches and while moving about the axis of the tube at the speed at which the bunches rotate about their axes. A second conveyor advances the tube lengthwise at a speed which exceeds the speed of lengthwise movement of the bunches in the first conveyor so that the tube breaks between successive wrapped bunches due to weakening of the respective portions of the tube by the needles. The second conveyor rotates the tube at the same speed at which the first conveyor rotates the bunches.

11 Claims, 4 Drawing Figures

Fig.1
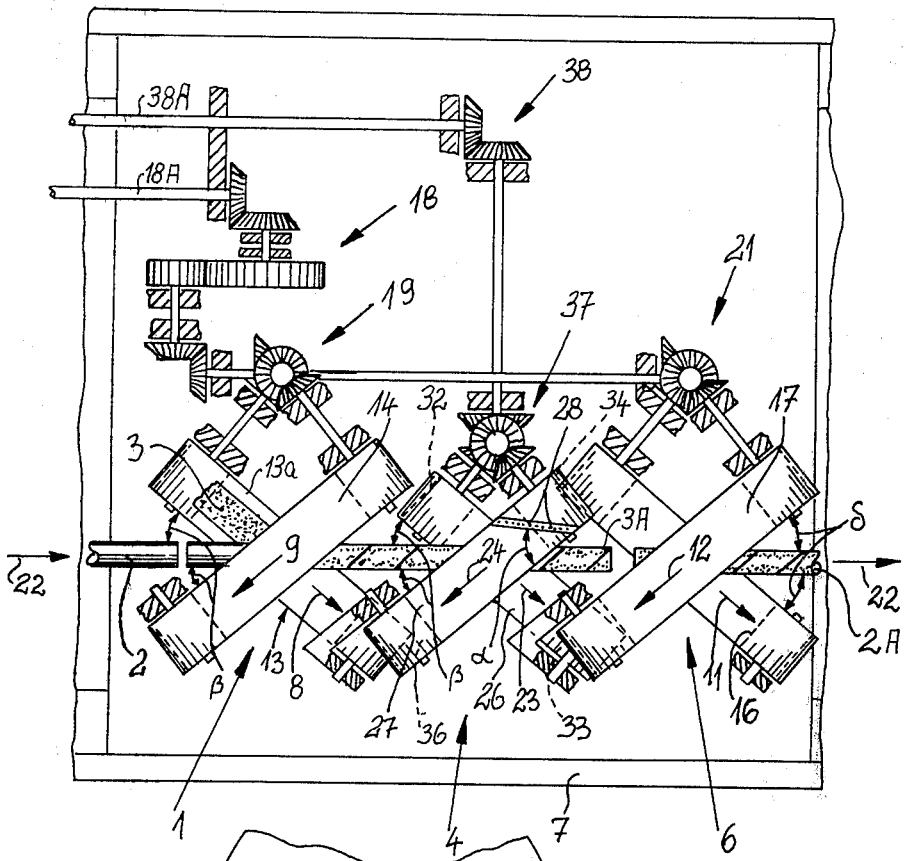
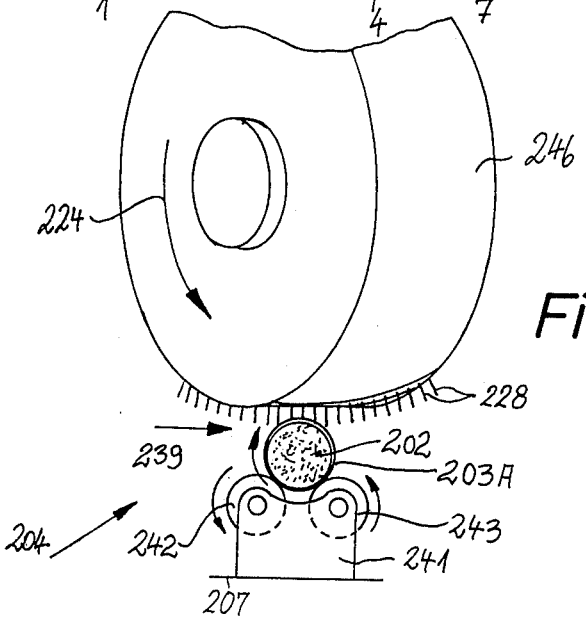
Fig.4

APPARATUS FOR MAKING AND SEPARATING WRAPPED CIGAR BUNCHES

BACKGROUND OF THE INVENTION

The present invention relates to apparatus for wrapping tobacco fillers or bunches to form cigars, cigarillos or analogous smokers' products (hereinafter called cigars). More particularly, the invention relates to improvements in apparatus of the type wherein successive discrete tobacco fillers (hereinafter called bunches) are wrapped into an adhesive-coated web in a manner as disclosed, for example, in the commonly owned U.S. Pat. No. 3,461,881 granted Aug. 19, 1969, to form a series of interconnected cigars which are thereupon separated from each other. Still more particularly, the invention relates to improvements in mechanisms or units which are used in such apparatus to sever or subdivide a continuous wrapper or tube of helically convoluted adhesive-coated strip or web stock to produce discrete cigars.

U.S. Pat. No. 3,461,881 discloses an apparatus wherein a conveyor moves a single file of bunches lengthwise and causes the bunches to rotate about their axes. A web of adhesive-coated wrapping material is fed at an oblique angle so that it is convoluted around the bunches in the form of a helix and forms a continuous tube which is thereupon severed by a cutoff so that the cigars are separated from each other and can be moved lengthwise into a magazine, tray or to another destination. The cutoff comprises a sleeve which moves lengthwise in and counter to the direction of lengthwise movement of the tube and an orbiting knife which also moves in and counter to the direction of lengthwise movement of bunches and severs the tube in the sleeve while moving in the direction of and at the exact speed of movement of the tube. A drawback of such cutoffs is that the mass of their parts is considerable so that they cannot be reciprocated at a speed which is needed in a high-speed apparatus. Thus, such types of severing means limit the output of the cigar making apparatus. Moreover, a cutoff with a reciprocating knife and a reciprocating sleeve is rather complex, expensive and prone to malfunction.

It was further proposed to sever the continuous rotating tube which surrounds a single file of cigar bunches by a knife which does not rotate but merely moves lengthwise with the tube during penetration into the convoluted web. This reduces the mass of moving parts. However, such means for severing the tube also failed to find widespread acceptance because the severing action is performed by a relatively small portion of the knife blade which becomes dull after extremely short periods of use so that the apparatus must be arrested at frequent intervals in order to allow for a replacement of the knife. Alternately, the apparatus must be provided with a complex mechanism for displacing the knife relative to its holder so as to move different portions of the blade into severing engagement with the tube.

Cutoffs of the type normally employed for subdividing a continuous rod of tobacco into discrete cigar bunches are very expensive and, therefore, there exists an urgent need for relatively simple but reliable means for separating a succession of interconnected wrapped cigar bunches from each other to form discrete cigars.

In accordance with still another proposal, the apparatus employs a first conveyor which rotates successive bunches of a single file about their axes and moves the bunches lengthwise while a device feeds an adhesive-coated web obliquely into the path of successive bunches so that the web is convoluted around the bunches and forms a continuous tube consisting of partially overlapping helices. The tube is then engaged by a second conveyor which rotates the tube at a higher speed so that portions of the tube between successive bunches are twisted and thereby automatically separated from each other. Such proposal has met with limited success because the separation of wrapped bunches is not reproducible with a sufficient degree of accuracy and also because the twisted portions of the tube affect the appearance of the cigars.

SUMMARY OF THE INVENTION

An object of the invention is to provide an apparatus for applying tubular wrappers to tobacco fillers, especially to cigar bunches, with novel and improved means for separating wrapped fillers from each other.

Another object of the invention is to provide an apparatus wherein the separation of wrapped fillers can be carried out at a high rate of speed which is determined by the characteristics of instrumentalities other than the actual separating means.

A further object of the invention is to provide an apparatus whose compactness at least matches the compactness of conventional apparatus, which can be readily adjusted to wrap tobacco fillers and to separate wrapped fillers at a desired rate, and wherein the means for separating wrapped fillers is simpler, more readily accessible, longer-lasting and requires less maintenance than presently known separating means.

An additional object of the invention is to provide a cigar making apparatus with novel means for breaking the wrapper which surrounds successive cigar bunches.

The improved apparatus is used to convert a file of aligned rod-shaped tobacco fillers (particularly cigar bunches) and a continuous adhesive-coated web into discrete wrapped fillers and comprises first conveyor means for moving the file of aligned fillers lengthwise along a predetermined path at a first speed and for simultaneously rotating the fillers about their axes, means for feeding the web lengthwise and obliquely toward the path of the fillers so that the web is automatically convoluted around successive fillers and forms a tube consisting of partially overlapping helices, means for reducing the tensile strength of longitudinally spaced portions of the tube between successive fillers (whereby the reduction of tensile strength does not involve a complete severing of the tube), and second conveyor means for moving the tube lengthwise along the path of the fillers at a higher second speed so that the tube breaks at the longitudinally spaced portions of reduced tensile strength.

The means for reducing the tensile strength of longitudinally spaced portions of the tube preferably comprises an endless carrier which is arranged to travel along a second path making a first oblique angle with the path for the rod-shaped fillers between the first and second conveyor means, and a row of needles or otherwise configurated projections extending from the carrier and making with the second path a second oblique angle so that the projections penetrate at intervals into successive longitudinally spaced portions of the tube while moving with the tube at the speed of lengthwise movement of the tube and while simultaneously moving about the axis of the tube at the speed of rotation of fillers about their axes. The sum of the first and second angles is preferably 90°.

The first conveyor means preferably comprises two endless flexible elements having filler-engaging stretches which cross each other in space. One of these stretches is preferably parallel to the second path.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is a somewhat schematic plan view of an apparatus which embodies one form of the invention;

FIG. 4 is a similar side elevational view of a third unit.

DESCRIPTION OF THE PREFERRED EMBODIMENTS

Figure 2:
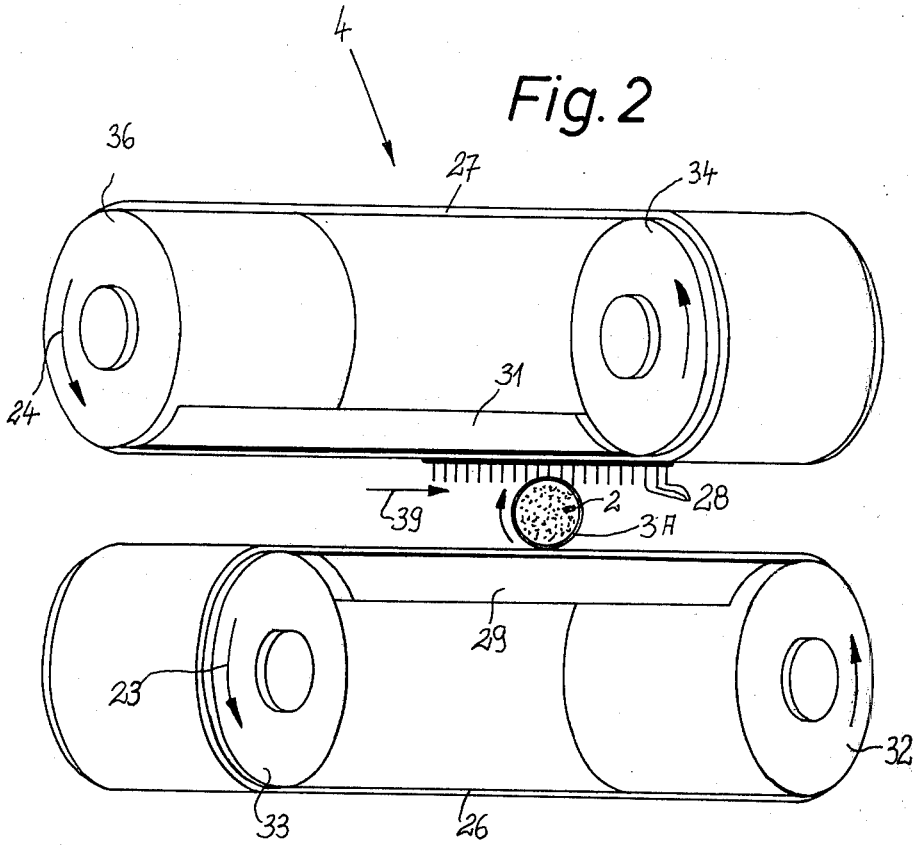
FIG. 2 is an enlarged side elevational view of a unit which forms part of the apparatus shown in FIG. 1 and serves to reduce the tensile strength of longitudinally spaced portions of the tube.

FIG. 1 shows an apparatus for wrapping cigar bunches 2 into a continuous web 3 of adhesive-coated wrapping material, e.g., a web of reconstituted tobacco. The apparatus comprises a support 7 which may constitute the frame of a cigar making machine or the frame of a discrete machine which is independent of a cigar making machine and receives bunches from a suitable magazine, not shown. In the latter instance, the apparatus comprises a suitable device (not shown) which removes from the magazine a single file of bunches 2 and advances such bunches at a speed which is identical with the speed of movement of bunches through a wrapping station.

The frame 7 supports a first conveyor 1 which is located at the aforementioned wrapping station, a second conveyor 6, and a weakening unit 4 which is installed between the two conveyors and serves to reduce the tensile strength of longitudinally spaced portions of a tube 3A which is obtained by convoluting the web 3 around successive fillers 2. The conveyor 1 comprises two endless flexible elements in the form of belts 13, 14 having stretches which cross each other in space and serve to advance successive bunches 2 lengthwise as well as to rotate the bunches about their respective axes. The direction in which successive bunches 2 of a single file of bunches are moved lengthwise by the belts 13, 14 is indicated by arrows 22. The web 3 which is to be convoluted about successive bunches 2 so as to form the tube 3A is supplied by the upper stretch 13*a* of the lower belt 13 of the first conveyor 1. The means for feeding bunches 2 lengthwise so that they enter the space between the upper stretch 13*a* of the belt 13 and the lower stretch of the belt 14 may include a rapidly rotating accelerator cam (not shown) which propels the bunches at the discharge end of a cigar bunch making machine or which propels bunches leaving a suitable magazine, depending upon whether the frame 7 forms part of a cigar making machine or of a discrete machine for wrapping bunches 2 into the web 3 and for thereupon separating successive cigars 2A from each other. The adhesive-coated side of the web 3 on the upper stretch 13*a* of the belt 13 faces the lower stretch of the belt 14. The directions in which the belts 13, 14 of the first conveyor 1 are driven are respectively indicated by arrows 8 and 9.

The second conveyor 6 is designed to advance the cigars 2A at a speed which exceeds the speed of the bunches 2 in the first conveyor 1. This insures that each preceding cigar 2A is separated from the next-following cigar in a region which is determined by the weakening unit 4. The distance between the region where the lower stretch of the belt 14 overlies the upper stretch 13*a* of the belt 13 and the region where the lower stretch of the upper endless belt 17 of the conveyor 6 overlies the upper stretch of the lower endless belt 16 of the conveyor 6 is less than the length of a bunch 2. The directions in which the belts 16, 17 of the second conveyor 6 are driven are indicated by arrows 11 and 12. It will be noted that the construction of the conveyor 6 is practically identical with that of the conveyor 1. The means for feeding the web 3 onto the upper stretch 13*a* of the belt 13 in the conveyor 1 is not shown; such means may be constructed and assembled in a manner as disclosed in the commonly owned U.S. Pat. No. 3,461,881 granted Aug. 19, 1969.

The main prime mover of the apparatus comprises an output shaft 18A which drives a gearing 18 which, in turn, drives two sets of bevel gears 19 and 21. The bevel gears 19 drive the rollers or pulleys for the belts 13, 14 and the bevel gears 21 drive the rollers or pulleys for the belts 16, 17. The transmission ratio of bevel gears 21 is higher than that of the bevel gears 19 so that the speed of lengthwise movement of the belts 16, 17 exceeds the speed of the belts 13, 14. The difference between the speeds of the belts 16, 17 and 13, 14 need not be substantial but must suffice to insure that the cigars 2A can be separated from each other not later than when their trailing ends reach the region of overlap of the belts 16 and 17. The angles delta which the stretches of the belts 16 and 17 enclose with the direction of lengthwise movement of cigars 2A are at least slightly smaller than the angles beta which the stretches of the belts 13, 14 enclose with the direction indicated by arrows 22. This insures that the speed at which the bunches 2 are rotated about their axes during travel through the conveyor 1 is identical with the speed at which the cigars 2A are being rotated about their axes during travel between the belts 16, 17 of the conveyor 6. However, and as mentioned above, the speed of lengthwise movement of cigars 2A exceeds the speed of lengthwise movement of bunches 2.

The details of the weakening unit 4 are shown in FIG. 2. This unit also comprises two endless flexible elements 26 and 27 in the form of belts crossing each other in space in a manner similar to that of the belts 13, 14 or 16, 17. The lower belt 26 is trained over rollers 32, 33 and is driven to move in the direction indicated by arrow 23. The upper belt 27 is preferably an internally toothed belt and is trained over toothed rollers 34, 36 so as to advance in the direction indicated by arrow 24. The upper stretch of the belt 26 is held against sagging by a plate-like back support 29 and serves to support the wrapped portions of successive bunches 2 during lengthwise movement toward engagement with the belts 16, 17 of the conveyor 6.

The upper belt 27 of the weakening unit 4 constitutes a mobile carrier for a row of weakening elements 28 here shown as discrete needles or projections which can puncture the tube 3A so as to reduce the tensile strength of the convoluted web 3 in the region between a finished cigar 2A and a bunch 2 which is in the process of being converted into a cigar. The lower stretch of the belt 27 travels below a plate-like back support 31 so that the needles 28 cannot yield during penetration into the tube 3A. The needles 28 form a row (see FIG. 1) which makes with the longitudinal direction of the belt 27 an angle alpha. The stretches of the belt 27 make with the axes of adjacent bunches 2 an angle beta which corresponds to the angle between the stretches of the belt 13 or 14 and the direction indicated by arrows 22. The sum of the angles alpha and beta is 90 degrees. It will be noted that the belts 26 and 27 are respectively parallel to the belts 13 and 14.

The prime mover of the cigar making machine or of the apparatus including the structure of FIGS. 1 and 2 has a second output shaft 38A which drives two sets of bevel gears 38 and 37. The bevel gears 37 drive the rollers 32, 34 of the belts 26, 27 in such a way that the speed of the belts 26, 27 equals or very closely approximates the speed of the belts 13, 14. Due to such speed of the belts 26, 27 and due to the aforediscussed feature that the sum of the angles alpha and beta is 90 degrees, the needles 28 are caused to move in the direction indicated by arrows 22 at the exact speed of lengthwise movement of bunches 2 and the needles 28 simultaneously travel transversely of the path of cigar bunches 2 at the exact speed at which the bunches rotate or roll about their own axes. This insures the formation of clean perforations or punctures which form an annulus located in a plane which is normal to the path of lengthwise movement of the bunches 2 and cigars 2A. The direction of transverse movement of needles 28 (while the belt 27 travels in the direction of arrow 24) is indicated by arrow 39 shown in FIG. 2.

The operation:

The bunches 2 are fed lengthwise along a straight path to form a single file wherein the neighboring bunches are separated from each other by relatively narrow gaps as shown in the left-hand portion of FIG. 1. The foremost bunch 2 is engaged by the neighboring stretches of the belts 13,14 of the first conveyor 1 and is moved lengthwise (arrows 22) and is simultaneously compelled to rotate about its own axis. The upper stretch 13*a* of the belt 13 furnishes the adhesive-coated web 3 which is convoluted around the foremost bunch 2 to form a tube 3A consisting of partially overlapping helices. The leader of the foremost bunch 2 then reaches the belts 26, 27 of the weakening unit 4 and is supported by the upper stretch of the lower belt 26 in the region above the back support 29. The needles 28 penetrate into the tube 3A in the region ahead of the leader of the foremost bunch 2 to form therein an annulus of perforations or punctures whereby such perforations reduce the tensile strength of the tube 3A sufficiently to permit a separation of the preceding cigar 2A from the next-following cigar with the formation of a clean line of separation between the tube 3A of the preceding cigar and the tube of the next-following cigar. As explained above, the belt 27 is inclined in such a way, this belt travels at such a speed, and the row of needles 28 is also inclined in such a way that the needles travel in the direction of arrow 39 at the exact speed of rolling movement of partially wrapped bunch 2 between the belts 26 and 27. The length of the row of needles 28 is selected with a view to insure that the perforations in the tube 3A form a complete annulus so that the weakening of the tube 3A is uniform all the way along its periphery.

The belts 16, 17 of the second conveyor 6 move the foremost cigar 2A lengthwise at a speed which exceeds the speed of the bunches 2 so that the cigar is separated from the next-following cigar or partially wrapped bunch 2 along the line of perforations formed by the needles 28. The belts 16, 17 thereupon increase the distance between the freshly separated cigar 2A and the next-following cigar or partially wrapped bunch 2. Successively separated cigars 2A can be fed into a magazine, into a tray or directly into the hopper of a packing machine, not shown.

It will be noted that, in contrast to the operation of a conventional cutoff, the weakening unit 4 merely reduces the tensile strength of longitudinally spaced portions of the tube 3A without, however, actually severing the tube in the regions between successive cigars 2A. The actual separation is effected by the belts 16, 17 in cooperation with the belts 13, 14 and 26, 27. The punctures formed by the needles 28 form a complete annulus so that the separation of successive cigars is clean and reproducible with a high degree of accuracy. The tip of each needle which is about to penetrate, which thereupon penetrates and which is ultimately retracted from the tube can be said to constitute a point travelling with the tube at the speed of the bunches and travelling about the axis of the tube at the speed at which the bunches rotate. Since the distance between the region of overlap of the belts 13, 14 and the region of overlap of the belts 16, 17 is less than the length of a bunch 2, successively wrapped cigars 2A are invariably separated from the next-following bunches not later than when the respective weakened portions of the tube 3A reach the conveyor 6.

Figure 3:
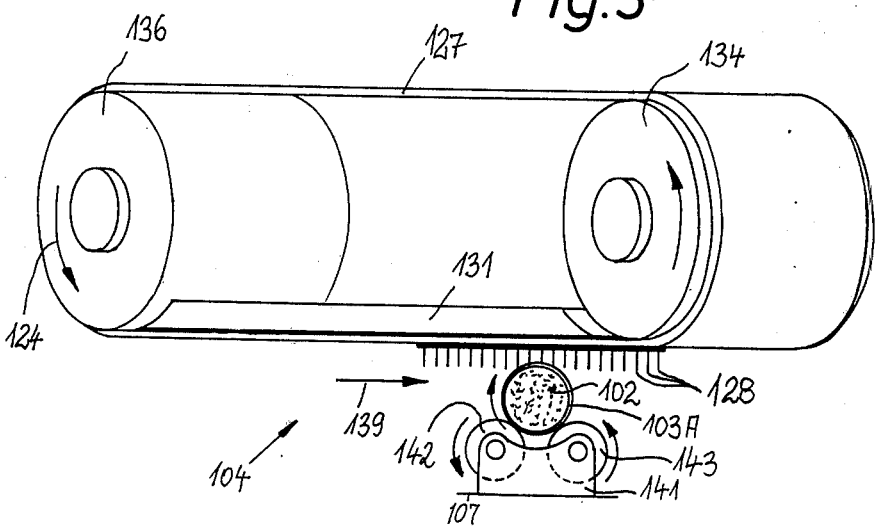
FIG. 3 is a similar side elevational view of a modified unit.

FIG. 3 illustrates a portion of a second weakening unit 104 wherein all such parts which are identical with or clearly analogous to the corresponding parts of the weakening unit 4 are denoted by similar reference characters plus 100. The lower endless flexible element 26 of the weakening unit 4 is replaced by two parallel rolls 142, 143 which rotate in directions indicated by arrows, either because they are positively driven or because they are rotated by the rolling bunches 102. The rolls 142, 143 are mounted in a holder or bracket 141 which is mounted in or on the frame 107. The rolls 142, 143 form a simple cradle wherein the tube 103A and the bunches 102 move lengthwise (while also rotating about their axes) during penetration of needles 128 into the tube 103A so that the latter is weakened sufficiently to permit for reproducible separation of successive cigars from each other during travel between the belts of the second conveyor (not shown in FIG. 3). The row of needles 128 moves in the direction indicated by arrow 139, i.e., at right angles to the axis of the tube 103A.

FIG. 4 shows a further weakening unit 204 which is similar to the unit 104 of FIG. 3; therefore, all such parts of the unit 204 which are identical with or clearly analogous to the corresponding parts of the unit 104 are denoted by similar reference characters plus 100. The main difference is that the carrier for the row of needles 228 is a drum-shaped rotary member 246 which is driven to rotate in the direction indicated by arrow 224. Also, the row of needles 228 which extend from the periphery of the drum-shaped carrier 246 forms a portion of a helix. The mode of operation of the unit 204 is practically identical to that of the unit 4 or 104.

The improved apparatus exhibits the advantage that it employs an extremely simple, compact and inexpensive weakening unit for reducing the tensile strength of longitudinally spaced portions of the tube 3A, 103A or 203A. The inertia of moving parts of the weakening unit has no bearing on the accuracy and reproducibility of the weakening action because the lower conveyor means 26, 142–143 or 242–243 of the unit 4, 104 or 204 rotates continuously and because the carrier 27, 127 or 246 for the needles 28, 128 or 228 also moves continuously. This insures that the output of the weakening unit (i.e., the frequency at which the row of needles penetrates into longitudinally spaced portions of the tube can be increased practically at will, i.e., that the reduction of tensile strength of such portions of the tube can take place at a frequency which is dictated by the operating speed of the slowest component or unit of the apparatus which need not be the weakening unit.

Another important advantage of the improved apparatus is that the weakening elements 28, 128 or 228 are subjected to negligible wear so that they can stand long periods of useful life. This is attributed to the fact that the weakening elements can constitute simple needles which merely puncture but need not rip or tear the tube 3A, 103A or 203A. It has been found that needles made of a suitable steel or a similar material can be used for extremely long periods of time, i.e., for periods which are long enough to warrant the disposal of needles with or without their carrier rather than a continuous or intermittent grinding or sharpening which is customary in presently known severing units for wrapped cigar bunches.

Without further analysis, the foregoing will so fully reveal the gist of the present invention that others can, by applying current knowledge, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

We claim:

1. Apparatus for converting a file of aligned rod-shaped tobacco fillers and a continuous adhesive-coated web into discrete wrapped fillers, comprising first conveyor means for moving said file of aligned fillers lengthwise along a predetermined path at a first speed and for simultaneously rotating said fillers about their axes; means for feeding said web lengthwise and obliquely toward said path so that the web is convoluted around successive fillers and forms a tube which moves lengthwise, rotates about its axis, and consists of partially overlapping helices; means for reducing the tensile strength of longitudinally spaced annular portions of said tube intermediate successive fillers while the tube moves lengthwise and rotates about its axis, comprising means for circumferentially perforating said tube, said annular portions of reduced tensile strength continuing to connect the preceding and next-following portions of the tube to each other; and second conveyor means for moving said tube lengthwise along said path at a higher second speed so that said tube breaks at said longitudinally spaced annular portions of reduced tensile strength.

2. Apparatus as defined in claim 1, wherein said means for reducing the tensile strength of said annular portions of said tube comprises an endless carrier arranged to travel along a second path making a first oblique angle with said first mentioned path intermediate said first and second conveyor means, and a row of projections extending from said carrier and making with said second path a second oblique angle so that the projections of said row penetrate at intervals into successive longitudinally spaced annular portions of said tube while moving with and at the speed of lengthwise movement said tube and while simultaneously moving transversely of the axis of said tube at the speed of rotation of said fillers about their axes.

3. Apparatus as defined in claim 2, wherein the sum of said first and second angles is 90°.

4. Apparatus as defined in claim 2, wherein said first conveyor means comprises two endless flexible elements having filler-engaging stretches crossing each other in space, one of said stretches being parallel to said second path.

5. Apparatus as defined in claim 2, wherein said projections are needles.

6. Apparatus as defined in claim 2, wherein said carrier is an endless flexible element.

7. Apparatus as defined in claim 6, wherein said belt is a toothed belt and further comprising a pair of toothed rollers and means for rotating one of said rollers, said belt being trained over said rollers.

8. Apparatus as defined in claim 2, wherein said carrier is a rotary member having a fixed axis of rotation.

9. Apparatus as defined in claim 1, wherein each of said fillers has a predetermined length and the distance between said first and second conveyor means is less than said predetermined length.

10. Apparatus as defined in claim 1, wherein said means for feeding said web forms part of said first conveyor means.

11. Apparatus as defined in claim 1, wherein said means for reducing the tensile strength of said tube includes a mobile support for said tube at one side of said path, a mobile carrier at the other side of said path opposite said support, and a row of projections provided on said carrier and arranged to form annuli of perforations in said longitudinally spaced annular portions of said tube.

* * * * *